United States Patent [19]

Reist

[11] Patent Number: 4,866,910

[45] Date of Patent: Sep. 19, 1989

[54] METHOD AND APPARATUS FOR TRANSFERRING PRINTED PRODUCTS ARRIVING IN AT LEAST ONE CONTINUOUS PRODUCT STREAM TO THE INFEED PATHS OR LINES OF AT LEAST TWO PROCESSING STATIONS

[75] Inventor: Walter Reist, Hinwil, Switzerland

[73] Assignee: Ferag AG, Hinwil, Switzerland

[21] Appl. No.: 123,585

[22] Filed: Nov. 19, 1987

[30] Foreign Application Priority Data

Nov. 21, 1986 [CH] Switzerland ..... 4668/86

[51] Int. Cl.[4] ..... B65H 29/00; B65H 31/24; B65H 39/075

[52] U.S. Cl. ..... 53/430; 53/118; 242/55; 242/56.9; 242/59

[58] Field of Search ..... 53/430, 118, 116; 242/56.9, 59, 55, 67.1 R, 58.6

[56] References Cited

U.S. PATENT DOCUMENTS

| | | | |
|---|---|---|---|
| 2,849,236 | 8/1958 | Beaulieu | 271/88 |
| 4,063,693 | 12/1977 | Achelpohl et al. | 53/118 X |
| 4,416,426 | 11/1983 | Cooper | 242/56.9 |
| 4,441,661 | 4/1984 | Steinmair | 242/55 |
| 4,580,739 | 4/1986 | Linder | 53/430 |
| 4,676,496 | 6/1987 | Honegger | 242/55 X |
| 4,684,118 | 8/1987 | Boss et al. | 53/118 X |
| 4,703,901 | 11/1987 | Stauber | 242/79 X |

FOREIGN PATENT DOCUMENTS

| | | |
|---|---|---|
| 318384 | 1/1920 | Fed. Rep. of Germany . |
| 362435 | 10/1922 | Fed. Rep. of Germany . |
| 3304219 | 10/1983 | Fed. Rep. of Germany . |
| 559691 | 1/1975 | Switzerland . |
| 623794 | 6/1981 | Switzerland . |
| 2111028 | 6/1983 | United Kingdom . |
| 2134084 | 8/1984 | United Kingdom . |
| 2170793 | 8/1986 | United Kingdom . |

*Primary Examiner*—James F. Coan

*Attorney, Agent, or Firm*—Bell, Seltzer, Park & Gibson

[57] ABSTRACT

At least one continuously arriving product stream of printed products is to be transferred to the infeed paths or lines of two or more processing stations. To ensure that the distribution of the arriving product stream can be accomplished as continuously as possible and accommodated optimumly to the requirements of the processing stations, the product stream is guided such that it crosses the infeed paths. At the crossings or cross-over locations the product stream is at least periodically delivered to a storage device and at the same crossings or cross-over locations printed products are simultaneously transferred out of the storage device and at a transfer location delivered to an infeed location of the associated infeed path or line. Thus, at each crossing there is present an intermediate store or buffer of products which, on the one hand, renders possible a continuous conveyance of the product stream and, on the other hand, affords a continuous mode of operation of the processing stations.

16 Claims, 4 Drawing Sheets

METHOD AND APPARATUS FOR TRANSFERRING PRINTED PRODUCTS ARRIVING IN AT LEAST ONE CONTINUOUS PRODUCT STREAM TO THE INFEED PATHS OR LINES OF AT LEAST TWO PROCESSING STATIONS

CROSS-REFERENCE TO RELATED PATENTS

This application is related to the commonly assigned U.S. Pat. No. 4,676,496, granted June 30, 1987, entitled "METHOD AND APPARATUS FOR SUPPLYING PRINTED PRODUCTS TO A CONTINUOUSLY OPERATING PROCESSING LINE" and the commonly assigned U.S. Pat. No. 4,703,901, granted Nov. 3, 1987, and entitled "APPARATUS FOR EXCHANGING WINDING FRAMES AND USED AT A WINDING STATION FOR PRINTED PRODUCTS".

BACKGROUND OF THE INVENTION

The present invention relates to a new and improved method of, and apparatus for, transferring products, typically printed products, to the infeed paths or lines of at least two processing stations, the printed products arriving in at least one continuous product stream.

In its more specific aspects the present invention relates to a new and improved method for transferring printed products arriving in at least one continuous product stream, especially in an imbricated or shingled product stream, to the infeed paths or lines of at least two processing stations or the like.

As indicated previously, there is also contemplated an apparatus for transferring products, particularly printed products arriving in at least one continuous product stream, especially in an imbricated or shingled printed product stream, to the infeed paths or lines of at least two processing stations or the like. There is provided at least one conveyor device or conveyor for the infeed of the products.

In the context of this disclosure the expression "processing station" or equivalent terminology, is intended to encompass, in each case, a piece of equipment or machine which further processes typically, for instance, printed products continuously arriving by means of a conveyor or conveyor device from a printing press. As to such product processing operation which may be undertaken, such can, for instance, constitute combining or collating the continuously arriving printed products with other printed products so as to form a finished or final product, or inserting or stuffing an insert or the like into each of the printed products. Other processing operations which are possible at each such processing station are, for instance, stacking the printed products, packaging the printed products, tying and/or strapping the printed products, applying addresses to the printed products or cutting the same to a desired format or size. These further processing operations can either be accomplished during throughpass of the products, in other words can be undertaken continuously, such as for instance the operation of stuffing inserts into the printed products, or can be undertaken discontinuously or batch-wise, for instance during the packaging of the printed products. When keeping these various possibilities of operation of the processing stations in mind, it will be apparent that the operational mode of the product infeed paths or lines which are arranged upstream or forwardly of such processing stations can be continuous or discontinuous as the encountered situation and desired operations dictate. Frequently the capacity of such a processing station is not compatible or equal to that of the printing press or that of a conveyor which follows the printing press and/or there exists the desire to have part of the production undergo a certain further processing operation and a further part of the same production to experience a quite different further processing operation. In both situations it is therefore necessary to subdivide or selectively distribute the continuously arriving product stream or production of products.

Proposals have already been advanced in this technology to attain this product production subdivision in that there are incorporated switches into the conveyors or conveyor systems, the branches of which each then lead to a respective processing station or to an infeed path or line which is arranged upstream of such processing station. However, this requires that the momentarily supplied processing station must be capable of further processing, during a delivery interval or period of time, the arriving printed products. However, as already explained, frequently the take-up capacity of the processing stations is dependent upon the nature of the further processing operations which are to be accomplished, and therefore possibly may not be compatible with the output or delivery capacity of the conveyor device or system.

Also proposals have already been made to obtain the product subdivision or splitting-up of the products in that the conveyor system delivers, for instance, only each second printed product to the one infeed path or line and the remaining ones to the other infeed paths or lines. Also this solution is not completely satisfactory since it presupposes that the conveyor or conveyor system which infeeds the arriving product stream is a specially constructed individual conveyor. Moreover, at the processing stations operating in a batch-wise or discontinuous mode there must be additionally provided a dam-up or buffer region or area, so that there can be taken up the printed products which are delivered during the interpauses or intervals between two work cycles.

SUMMARY OF THE INVENTION

Therefore, with the foregoing in mind it is a primary object of the present invention to provide a new and improved method of, and apparatus for, transferring products, such as printed products arriving in at least one continuous product stream or flow, to the infeed paths or lines of at least two processing stations or the like, in a manner not afflicted with the aforementioned shortcomings and drawbacks as noted above.

Another more specific object of the present invention aims at the provision of a new and improved method of, and apparatus for, transferring products arriving in at least one continuous product stream to the infeed paths or lines or at least two processing stations in a more versatile, efficient, simpler and reliable fashion than was heretofore possible, while affording considerable flexibility in terms of the operating capacity or mode of the processing stations.

Still a further significant object of the present invention is concerned with a new and improved method of, and apparatus for, reliably, efficiently and adaptively infeeding to the infeed lines or paths of at least two processing or work stations products, typically printed products, arriving in at least one continuous product stream or flow.

A further noteworthy object of the present invention is to provide a more versatile system for delivering products to processing or work stations and which arrive in a continuous product stream, wherein the system can be adapted to the operating capacity or capability of the individual processing or work stations without disrupting the continuous infeed of the products.

Now in order to implement these and still further objects of the invention, which will become more readily apparent as the description proceeds, the method for transferring printed products arriving in at least one continuous product stream or flow, especially in an imbricated product stream or shingled product array, to the infeed paths or lines of at least two processing or work stations, is manifested by the features that the incoming product stream is engaged and guided in such a fashion that it crosses or over-crosses each of the product infeed paths or lines. At the product crossing or cross-over locations the product stream is at least periodically or intermittently delivered to a storage device or store which retains the formation of the product stream and which is simultaneously emptied at the region of the same crossing or cross-over location via a transfer location at the infeed path or line.

According to the proposed method of the present development, the product stream or flow of printed products is no longer directly transferred to the infeed path or line, rather first delivered to the product storage device or store which retains the formation or posture of the arriving product stream and then transfers the thus stored product stream in the same formation or posture to the associated infeed path or line. This is associated with the notable advantage that at the region of each crossing or cross-over location there is provided to a certain extent an intermediate storage or depot which always is filled and at the same time emptied or depleted of products. This emptying or depletion of the stored products is accomplished independent of the quantity of products which are delivered by the product stream and can be optimumly accommodated to the requirements of the subsequent processing station.

As noted previously, the invention is not only concerned with the aforementioned method aspects, but also pertains to a new and improved apparatus for the performance of such method. A preferred construction of inventive apparatus for the transfer of products, particularly printed products arriving in at least one continuous product stream, especially in an imbricated or shingled stream or product array, to the infeed paths or lines of at least two processing stations, with at least one conveyor or conveyor means infeeding the product stream, is manifested by the features that the conveyor or conveyor means crosses or crosses over each of the infeed paths or lines. The infeed paths or lines at each crossing or cross-over location possess at least one transfer location or position. At each crossing or cross-over location there is arranged a storage device or unit which, on the one hand, is aligned with the associated conveyor or conveyor means and, on the other hand, is aligned with the associated transfer location or position. Additionally, there are provided means in order to simultaneously load with products and to unload products at the storage device.

With the inventive apparatus it is possible to conveniently divide or split up the product production which arrives by the conveyor or conveyor means or device and to extensively overcome or at least appreciably reduce the previously noted difficulties.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Figure 1:
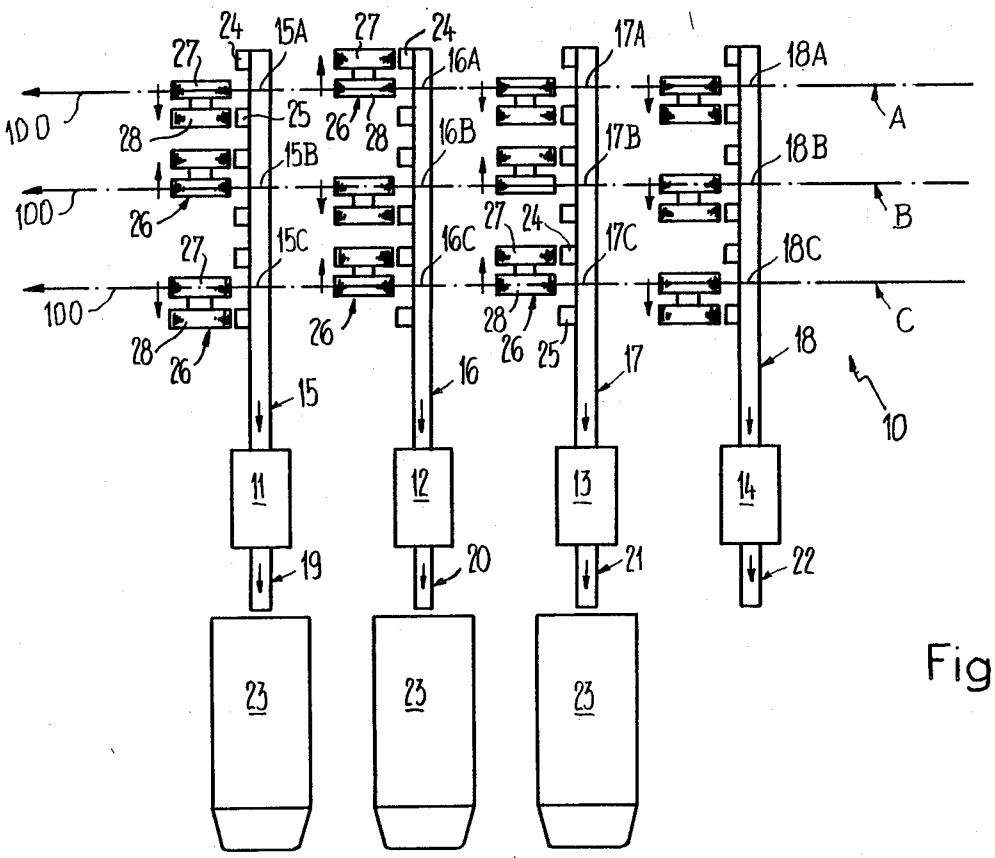
FIG. 1 is a schematic top plan view of an apparatus constructed according to the present invention incorporating three conveyors or conveyor devices and four processing or work stations.

Describing now the drawings, it is to be understood that for purposes of simplification of the illustration only enough of the construction of the apparatus or installation for transferring at least one continuous product stream or flow, such as typically printed products arriving continuously, to the infeed paths or lines of at least two processing or work stations, has been shown as needed for those skilled in the art to understand the underlying principles and concepts of the present invention. Turning attention now to FIG. 1 of the drawings, there has been schematically depicted therein in plan view an exemplary embodiment of apparatus or installation 10, for accomplishing the inventive method. Such apparatus or installation 10 will be seen to comprise three conveyors or conveyor devices A, B and C of known construction and thus merely conveniently indicated with chain-dot lines. These conveyors or conveyor devices A, B and C are effective for conveying products in the direction of the arrows 100 appearing at the left-hand side of FIG. 1 and representing the product conveying direction. Furthermore, there will be recognized, by way of example, in the illustrative embodiment four processing or work stations or units 11, 12, 13 and 14, the associated infeed paths or lines of which have been designated by reference numerals 15, 16, 17 and 18, respectively, and the outlet regions exit sides by reference numerals 19, 20, 21 and 22 respectively. At the specifically illustrated outlet regions or exit sides 19, 20 and 21 there is shown in FIG. 1 a respective transport facility or transport means 23 of any suitable design, for instance constituted by an associated forklift truck or a suitable delivery truck 23 in order to receive and transport away the products produced or processed by the processing or work stations 19, 20 and 21. Obviously, a suitable transport means 23 would also be provided for the further depicted outlet region or exit side 22 but has been conveniently omitted from the drawing of FIG. 1 to facilitate its illustration.

Figure 4:
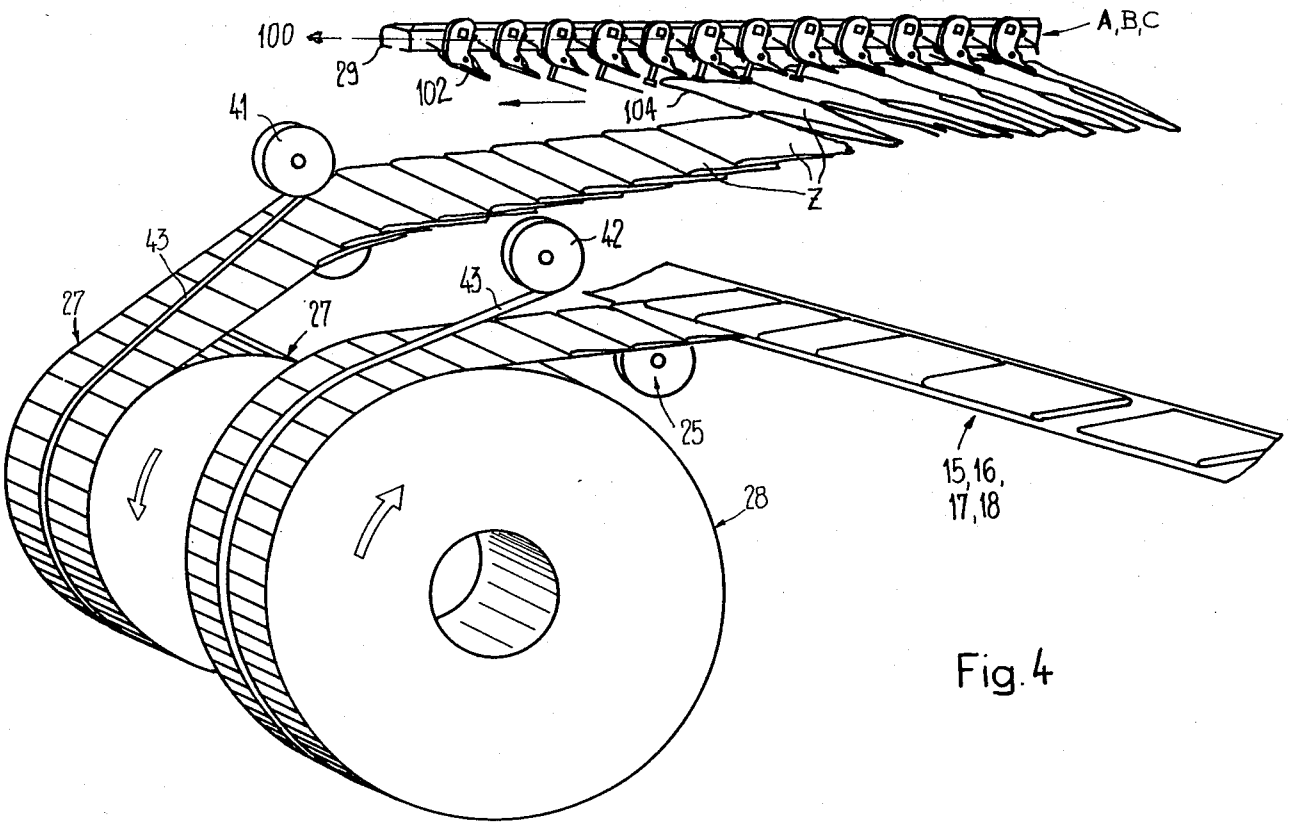
FIG. 4 is a schematic perspective illustration of parts of the twin package frame or stand and the associated conveyor or conveyor device at one of the crossing or cross-over locations of the arrangement of FIG. 1 in order to explain the mode of operation of the apparatus.

The conveyors or conveyor devices A, B and C are preferably endless revolvingly driven individual conveyors of the overhead-type construction which, as depicted for instance in FIG. 4, are provided with conventional controllable product grippers or grippers units 102 arranged in spaced relationship from one another, as is well known in this technology. Each of the controllable grippers or gripper units 102 engages an associated product Z, here for instance a printed product such as a newspaper, periodical or the like, at its leading edge 104 in terms of the product conveying direction 100. Such exemplary type of conveyor or conveyor device is disclosed, for instance, in U.S. Pat. No. 3,955,667, granted May 11, 1976, to which reference may be readily had and the disclosure of which is incorporated herein by reference.

On the other hand, the infeed paths or lines are constructed in adaptation to the therewith operatively associated processing or work stations 11, 12, 13 and 14 respectively, and can be constituted for instance by conventional conveyor bands or belts, small band or belt-like conveyors with or without entrainment elements or by entrainment elements moved along a slide or sliding support table or a slide rail.

From the exemplary embodiment depicted in FIG. 1 it will be apparent that all of the conveyors or conveyor devices A, B and C of all the infeed paths or lines 15, 16, 17 and 18 intersect or, stated in somewhat different terms, cross or cross-over one another at essentially right angles in relation to one another. The cross-over or crossing locations, which are twelve in number in the exemplary arrangement of FIG. 1, have been conveniently designated by reference characters 15A, 15B, 15C, 16A, 16B, 16C, 17A, 17B, 17C, and 18A, 18B, 18C, respectively. At the region of each of these cross-over locations 15A to 15C, 16A to 16C, 17A to 17C, and 18A to 18C, each of the infeed paths or lines 15, 16, 17 and 18, respectively, is provided with a pair of product transfer locations or regions 24 and 25. A respective pair of transfer locations or regions 24 and 25 has been particularly depicted in FIG. 1 for the crossing or cross-over locations 15A and 17C. Each pair of transfer locations 24 and 25 is arranged in spaced relationship from one another to opposite sides of the path of travel of the related conveyor A, B and C, as particularly evident for the pair of transfer locations 24 and 25 associated with the cross-over location 15A and again the pair of transfer locations 24 and 25 associated with the cross-over location 17C.

Furthermore, at the region of each of the cross-over locations 15A to 15C, 16A to 16C, 17A to 17C and 18A to 18C there is provided as a storage unit or device a twin package frame or stand 26 (package winding and unwinding frame or stand) as will be explained hereinafter. Each such twin or dual package frame or stand 26 carries two wound product packages or product coils 27 and 28, as will be particularly evident by referring to FIGS. 3 and 4. Instead of using as the storage unit or device the exemplary twin package frame or stand 26 depicted in the drawings, there also could be used as such storage unit or device a different type of storage equipment or product storage, such as a storage unit or device for forming a spiral stack as, for instance, disclosed in German patent No. 2,518,374 and the commonly assigned, cognate U.S. Pat. No. 4,274,623, granted June 23, 1982, wherein, however, the stacking table can be designed in the manner disclosed in the German patent No. 2,518,372, and the commonly assigned, cognate U.S. Pat. No. 4,000,806, granted Jan. 4, 1977, to all of which patent documentation reference may be readily had and the disclosures of which are incorporated herein by reference.

The product packages or coils 27 and 28 are mounted coaxially with respect to one another at a mutual spacing such that the one product package or its winding core, as will be disclosed more fully hereinafter, of one of the package frames or stands 26 is aligned with one of the conveyors such as the related conveyor A, B or C, as the case may be, whereas the other product package of the same package frame or stand 26, on the other hand, is aligned with one of the product transfer locations or positions 24 or 25, as the case may be, at the related crossing or cross-over location. For instance, by way of example and not limitation, in FIG. 1 at the crossing or cross-over location 15A of the infeed path or line 15 the product package 27 (or its winding core) is aligned with the conveyor or conveying device A and the other product package 28 is aligned with the product transfer location or position 25. In contrast thereto, at the crossing or cross-over location or position 17C the product package 28 (or its winding core) is aligned with the conveyor or conveyor device C and the other product package 27 is aligned with the product transfer location or position 24 at the infeed path or line 17.

As will be further explained and rendered evident, the package frames or stands 26 are appropriately displaceable or movable along the related infeed path or line with which they are operatively associated, so that in each instance one of the wound product packages 27 (or the other wound product package 28)—or the winding cores thereof— can be aligned with one of the associated conveyors or conveyor devices A, B and C, as the case may be, and then the other wound product package 28 (or the wound product package 27) will be automatically aligned with one of the product transfer locations 24 and 25 at the related crossing or cross-over location or position.

Figure 2:
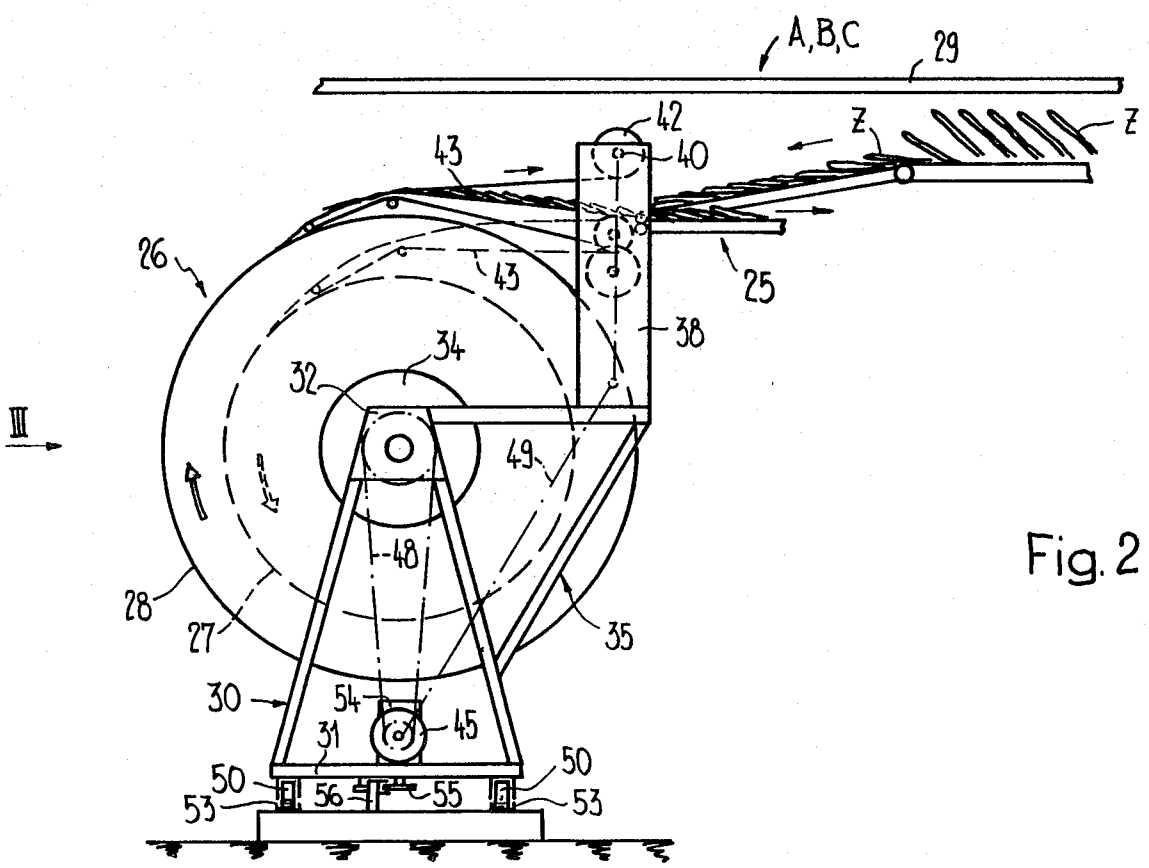
FIG. 2 is a schematic side view of one of the twelve twin or dual package frames or stands present in the exemplary arrangement of the apparatus depicted in FIG. 1.
Figure 3:
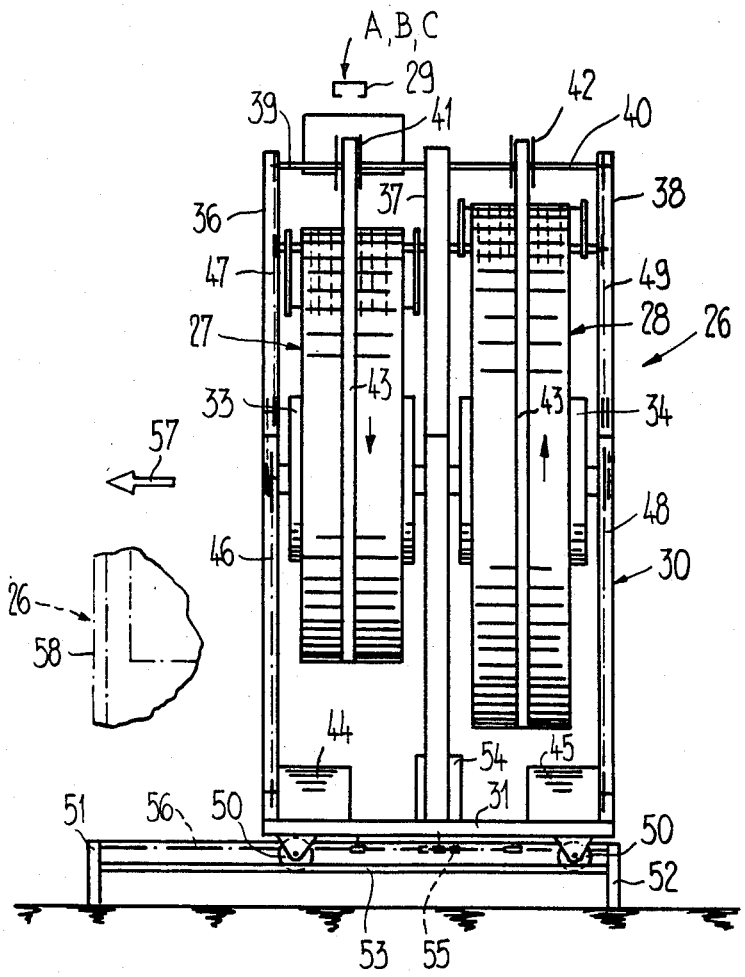
FIG. 3 is a view, looking in the direction of the arrow III of FIG. 2, of the twin package frame or stand depicted therein.

Reference will now be made more specifically to FIGS. 2 and 3 with the observation that the winding up or reeling of printed products into a wound product package and the unwinding or unreeling of such wound product package for the removal of the printed products therefrom is well-known in this technology. In this regard reference may be readily had to the German patent publication No. 3,236,866, published May 5, 1983, the German patent publication No. 3,244,663, published July 21,1983, or the German patent publication No. 3,244,664, and its cognate British patent application No. 2,111,028, published June 29, 1983, the disclosure of which are incorporated herein by reference. In FIGS. 2 ad 3 one of the conveyors or conveyor devices A, B and C has been indicated schematically only by means of its guide rail 29. The twin package (winding and unwinding) frame or stand 26 will be seen to comprise a support frame or support structure 30 which is provided with a base or floor portion 31. This support frame 30 possesses coaxially aligned bearings or support units 32 in which there are rotatably mounted two winding cores or mandrels 33 and 34 coaxially with respect to one another. As best seen by again reverting to FIGS. 2 and 3, upon the cantilever or protruding bracket supports 35 there are mounted three upright supports or support members 36, 37 and 38 (FIG. 3) in which not particularly illustrated but conventional bearings of two shafts 39 and 40 are arranged, if desired for substantially vertical movement. Upon the shaft or shaft member 39 there is seated a spool 41 and on the other shaft or shaft member 40 a spool 42. The spools or spool members 41 and 42 serve either for the braked release or for the positive take-up of a suitable winding band or strap 43, again as is well known in this technology.

In FIG. 3 there is shown the product package 27 which is in the process of being wound up or formed upon the winding core 33, whereas the other product package 28 supported on the core 34 is being unwound or unreeled. The winding cores or mandrels 33 and 34 (meaning the cores or mandrels for selecting winding-up or winding-off the products, as the case may be) as well as the associated spools or spool members 41 and 42, respectively, are driven independently of one another and, depending upon the contemplated function or operation, in the one or in the other rotational sense or direction. Accordingly, there is mounted at the base or floor 31 of the support frame 30 for each of the associated winding core/spool unit 33, 41 and 34, 42, a respective drive motor 44 and 45, for instance a reversible gearing or transmission motor which can be infinitely regulated as concerns its rotational speed and its direction of rotation. Each such depicted drive motor 44 and 45 drives by means of the here only schematically depicted winding gearing or drive unit, shown as a chain drive 46, 47 and 48, 49, respectively, the related winding core 33 and 34 and the associated spool 41 and 42, respectively, to selectively perform the corresponding winding-up or winding-off operation.

The entire twin package frame or stand 26 is movable or mobile by means of the travelling rolls or rollers 50 mounted at the base or floor 31 of the support frame or support structure 30 upon guide rails 53 in the direction of the lengthwise or winding or rotational axes of the winding cores or mandrels 33 and 34. The motion of the twin package or winding frames 26 on the guide rails 53 by means of the described travelling rolls 50 is limited by the end stops or limits 51 and 52 or equivalent structure. To realize the aforedescribed mobility of the twin package or winding frames or stands 26 there is additionally mounted at the base or floor 31 thereof a substantially vertical-axis reversible gearing or transmission motor 54 or equivalent drive means, the power take-off shaft of which piercingly extends through the base 31 and is provided with a gear 55. This power take-off gear 55 meshes with a standard gear rack 56 or the like which is fixedly arranged between both of the guide rails or rail members 53 (FIG. 2).

Now when the gearing or transmission motor 54 is turned-on then the entire twin package or winding frame 26 is displaced in FIG. 3 in the direction of the arrow 57 until it assumes the position indicated with the chain-dot lines 58. Although in the illustration of FIGS. 2 and 3 in the position depicted with full lines of the twin package or winding frame or stand 26, it is the product package 27 or its core or mandrel 33, as the case may be, which takes up the printed products Z by winding up the same and which products arrive from an associated one of the conveyors or conveyor devices A, B or C, as the case may be, and the previously wound products of the product package 28 are delivered or supplied to the transfer location or position 25, these product packages exchange their function in the position of the package frame or stand 26 depicted by the chain-dot lines 58. In so doing, the rotational direction of the drive motors 44 and 45 is reversed, and the package 28 or, as the case may be, the core or mandrel 34 for winding packages thereon, which is now aligned with one of the associated conveyors, such as one of the conveyors or conveyor devices A, B or C, as the case may be, again takes-up or receives printed products whereas the previously wound package 27 on the winding core or mandrel 27 delivers products to the transfer location or position 24 which is not particularly visible in FIG. 3, such as for the crossing or cross-over location 16A shown in the arrangement of FIG. 1.

One of the advantages of the twin package or winding frame or stand 26, in the context of the described equipment as herein-disclosed, resides in the fact that it is not necessary to lift a full or complete package out of the support frame 30. It is sufficient if the product grippers 102 of the related conveyor or conveyor device A, B or C, as the case may be, depicted in the arrangement of FIG. 4 of the transport structure, and for instance constructed in the manner disclosed previously in relation to U.S. Pat. No. 3,955,667, are controlled such that they no longer release the conveyed printed products Z at the corresponding crossing or cross-over location and that the drive motor which is operatively associated with the full wound product package is brought to standstill. Only when the other wound product package or core is empty, is the twin package or winding frame or stand 26 shifted and the drive motors 44 and 45 again switched on such that the packages now exchange their function, in other words at one of the cores there are wound up or reeled the printed products into a product package and at the other core where there is present a wound up product package the individual products are unwound or unreeled therefrom.

The described apparatus or installation is extremely flexible in its operation and can be employed with great versatility in larger printing plants because practically without requiring any conversion time the production from different printing presses can be delivered simultaneously or directly in succession for undergoing further processing or handling operations.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A method of transferring products arriving in at least one continuous product stream, especially in an imbricated stream of printed products, to the infeed paths of at least two processing stations, comprising the steps of:

engaging the product stream and guiding the engaged product stream such that it crosses each of the infeed paths at predeterminate crossing locations;

transferring at least for a predeterminate period of time at least part of the product stream at least at a predeterminate one of the crossing locations to an associated storage device at which there is stored the transferred part of the product stream while retaining the formation of the infed product stream; and during such transfer at the same time emptying at the region of said at least predeterminate one of the crossing locations at least a predominant portion of the stored products of the storage device at the region of a transfer location to an associated one of the infeed paths.

2. The method as defined in claim 1, further including the steps of:

winding up at the storage device the product stream into a first wound product package while during the same time unwinding previously wound up products from a second product package at the storage device; and delivering the unwound products of the second product package by means of the transfer location to said associated infeed path.

3. The method as defined in claim 2, further including the steps of:

forming a full first wound product package at said at least predeterminate one of the crossing locations; and upon formation of said full first wound product package delivering the product stream to a further one of said predeterminate crossing locations as long as the second wound product package at said at least predeterminate one of the crossing locations is not completely unwound.

4. A method of transferring products arriving in at least one continuous product stream, especially in an imbricated stream of printed products, to the infeed paths of at least two processing stations, comprising the steps of:

engaging the product stream and guiding the engaged product stream such that it crosses at least predeterminate ones of the infeed paths at predeterminate crossing locations;

transferring at least for a predeterminate period of time at least part of the product stream at least at a predeterminate one of the crossing locations to an associated storage device at which there is stored the transferred part of the product stream; and during the independent of such transfer emptying at the region of said at least predeterminate one of the crossing locations at least a predominant portion of the previously stored products of the storage device at the region of a transfer location to an associated one of the infeed paths.

5. An apparatus for transferring products, especially printed products arriving in at least one continuous product stream, especially in an imbricated product stream, to the respective infeed paths of at least two processing stations, comprising:

at least two processing stations;

means defining an infeed path for each said at least two processing stations for infeeding products thereto;

at least one conveyor means for infeeding the product stream towards the infeed path of each processing station;

said conveyor means crossing each of the infeed paths at a respective predeterminate crossing location;

said infeed paths comprising at each crossing location at least one product transfer location;

a storage device arranged at each crossing location;

said storage device being alignable with the conveyor means and with the transfer location; and means for simultaneously loading the storage device with products and emptying at least a predominant portion of stored products from the storage device.

6. The apparatus as defined in claim 5, wherein:

each of said storage devices arranged at each crossing location contains a common package frame means; and each of said package frame means comprising two individual and independently driveable winding cores for selectively reeling and unreeling products thereon and thereoff.

7. The apparatus as defined in claim 6, wherein:

each infeed path comprises at the region of the crossing location thereof two said transfer locations each arranged to a respective side of the conveyor means.

8. The apparatus as defined in claim 7, wherein:

said winding cores of the package frame means are arranged substantially coaxially with respect to one another and in spaced relationship to one another.

9. The apparatus as defined in claim 6, wherein:

said winding cores of the package frame means are arranged substantially coaxially with respect to one another and in spaced relationship to one another.

10. The apparatus as defined in claim 7, further including:

means for displaceably arranging the package frame means along an associated one of the infeed paths.

11. The apparatus as defined in claim 10, further including:

means for selectively displacing said package frame means along the associated infeed path;

reversible drive motor means provided at the package frame means for each winding core; and said reversible drive motor means being infinitely variable with respect to the rotational speed thereof.

12. The apparatus as defined in claim 5, wherein:

said at least one conveyor means crossing each of the infeed paths at the crossing locations essentially at right angles thereto.

13. The apparatus as defined in claim 6, wherein:

said at least one conveyor means comprises a plurality of conveyor means; and each of said plurality of conveyor means crossing each of the infeed paths at crossing locations arranged in spaced relationship from one another.

14. The apparatus as defined in claim 13, wherein: at least a part of the infeed paths are structured as collating devices.

15. A method of transferring products arriving in at least one continuous product stream, especially in an imbricated stream of printed products, to the infeed paths of at least two processing stations, comprising the steps of:

engaging the product stream and guiding the engaged product stream such that it crosses each of the infeed paths at predeterminate crossing locations;

transferring at least for a predeterminate period of time at least part of the product stream at least at a predeterminate one of the crossing locations to an associated storage device at which there are stored the transferred part of the product stream while retaining the formation of the infed product stream;

during such transfer at the same time emptying at the region of said at least predeterminate one of the crossing locations stored products of the storage device at the region of a transfer location to an associated one of the infeed paths;

during said steps of transferring and storing said part of said product stream, winding up at the storage device the product stream into a first wound product package while during the same time unwinding previously wound up products from a second product package at the storage device;

delivering the unwound products of the second product package by means of the transfer location to said associated infeed path; and upon formation of said full first wound product package delivering the product stream to a further one of said predeterminate crossing locations as long as the second wound product package at said at least predeterminate one of the crossing locations is not completely unwound.

16. An apparatus for transferring products, especially printed products arriving in at least one continuous product stream, especially in an imbricated product stream, to the respective infeed paths of at least two processing stations, comprising:

at least two processing stations;

means defining an infeed path for each said at least two processing stations for infeeding products thereto;

at least one conveyor means for infeeding the product stream towards the infeed path of each processing station;

said conveyor means crossing each of the infeed paths at a respective predeterminate crossing location;

said infeed paths comprising at each crossing location at least one product transfer location;

a storage device arranged at each crossing location;

said storage device being alignable with the conveyor means and with the transfer location;

means for simultaneously loading with products and emptying products from the storage device;

each of said storage devices arranged at respective ones of said crossing locations containing a common package frame means; and each said common package frame means comprising two individual and independently driveable winding cores for selectively reeling and unreeling products thereon and thereoff.

* * * * *

UNITED STATES PATENT AND TRADEMARK OFFICE

CERTIFICATE OF CORRECTION

PATENT NO. : 4,866,910

DATED : September 19, 1989

INVENTOR(S) : Walter Reist

It is certified that error appears in the above-identified patent and that said Letters Patent is hereby corrected as shown below:

Column 4, Line 59, after "regions", please insert --or--.

Column 5, Line 68, please delete "1982" and insert --1981--.

Column 6, Line 55, please delete "ad" and insert --and--.

Column 9, Line 39, please delete "the" and insert --and--.

Signed and Sealed this

Twenty-seventh Day of August, 1991

*Attest:*

*Attesting Officer*

HARRY F. MANBECK, JR.

*Commissioner of Patents and Trademarks*